US005439302A

United States Patent [19]

Andou et al.

[11] Patent Number: 5,439,302

[45] Date of Patent: Aug. 8, 1995

[54] SELF-ADJUSTING CONTROLLER FOR DOT IMPACT PRINTER

[75] Inventors: Hirokazu Andou; Mitsuru Kishimoto; Hideaki Ishimizu; Yoichi Umezawa; Toshiyuki Asaka, all of Tokyo, Japan

[73] Assignee: Oki Electric Industry Co., Ltd., Tokyo, Japan

[21] Appl. No.: 165,462

[22] Filed: Dec. 13, 1993

[30] Foreign Application Priority Data

Dec. 11, 1992 [JP] Japan ..... 4-330815

[51] Int. Cl.[6] ..... B41J 2/25

[52] U.S. Cl. ..... 400/124.07; 400/124.05; 400/279; 400/157.3

[58] Field of Search ..... 400/124, 157.2, 157.3, 400/166, 279, 55–59, 124.02, 124.04, 124.05, 124.06, 124.07

[56] References Cited

U.S. PATENT DOCUMENTS 5,039,237 8/1991 Tanuma et al. ..... 400/124

5,078,517 1/1992 Hiroshi et al. ..... 400/124

*Primary Examiner*—David A. Wiecking

*Assistant Examiner*—Steven S. Kelley

*Attorney, Agent, or Firm*—Wenderoth, Lind & Ponack

[57] ABSTRACT

A controller for a dot impact printer has capacitance sensors for sensing the motion of the dot wires in the print head, and a non-volatile, rewritable memory for storing self-adjustment data relating to dot-wire characteristics. A processor controls the driving of the dot wires according to the self-adjustment data stored in the memory. At certain times, the processor causes the dot wires to be driven in a test sequence and updates the self-adjustment data in the memory according to the resulting sensor output. Print quality is thereby maintained for the full guaranteed life of the print head.

13 Claims, 6 Drawing Sheets

SELF-ADJUSTING CONTROLLER FOR DOT IMPACT PRINTER

BACKGROUND OF THE INVENTION

This invention relates to a dot impact printer controller, more specifically to a controller that stores and updates self-adjustment data in order to maintain good print quality for the guaranteed life of the print head.

Dot impact printers are widely used in information-processing equipment because they combine relatively low cost with the ability to print on varied media. The print head of a dot impact printer is equipped with movable dot wires that press an ink ribbon against the printing medium, thereby printing dots. Print heads are classified as plunger-driven, spring-charged, or clapper-type. In a spring-charged print head, the dot wires are actuated by a mechanism comprising a permanent magnet, plate springs, and electromagnets. Conventionally, the printer is tested when manufactured and its controller is adjusted to provide exciting current pulses of an appropriate duration to the electromagnets. The pulse duration is not normally readjusted unless the printer is returned to the manufacturer for service.

During the life of a print head, the dot wires, electromagnet cores, and other parts of the printer are liable to wear down, increasing the gap between the printing medium and the dot wires, and causing possible printing problems such as missing dots. When the current pulse duration is adjusted at the factory, it is therefore adjusted not to the optimal value but to an intentionally longer value, to ensure that adequate current will be fed to the electromagnets to print each dot during the entire guaranteed life of the print head. This overdriving of the electromagnets has certain drawbacks, however, including unnecessary power consumption, unnecessary noise, and overheating of the print head.

SUMMARY OF THE INVENTION

It is accordingly an object of the present invention to ensure print quality despite wear to dot wires, electromagnet cores, and other printer parts.

Another object of the invention is to ensure print quality despite differences between different dot wires.

Yet another object is to provide substantially optimal drive current to the electromagnets of a printer throughout the service life of the printer.

The controller of the present invention comprises a drive circuit for feeding pulses of exciting current to the electromagnets of a dot impact printer, thereby actuating its dot wires, and a plurality of capacitance sensor electrodes that sense the motion of the dot wires. A sensor circuit converts the sensed motion to waveform data.

The controller also has a non-volatile memory for storing self-adjustment data. During normal printing, a processor controls the drive circuit in response to the self-adjustment data. At certain times, the processor executes a test sequence in which each dot wire is actuated in turn, and updates the self-adjustment data according to the waveform data resulting from the test sequence. By always printing according to conditions determined from the most recently updated self-adjustment data, the controller is able to maintain good printing quality despite wear to printer parts.

DETAILED DESCRIPTION OF THE INVENTION

An embodiment of the present invention will be described with reference to the attached drawings. These drawings illustrate the invention but do not restrict its scope, which should be determined solely from the appended claims.

Figure 1:
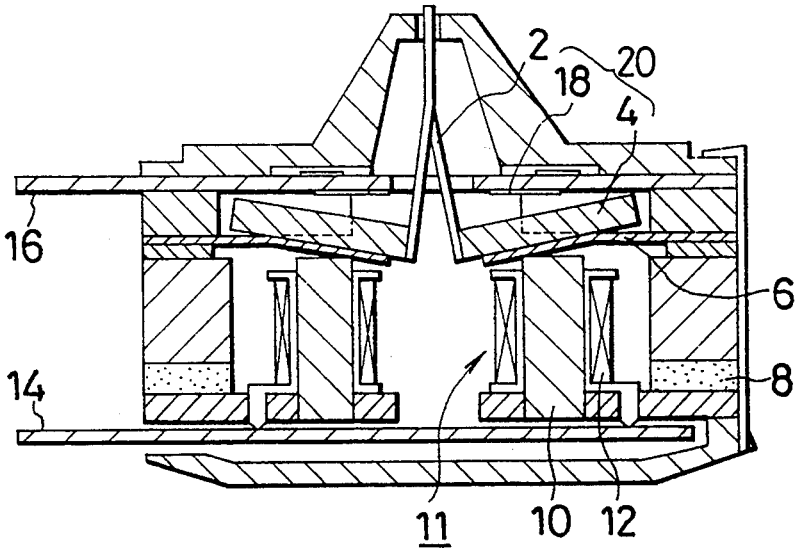
FIG. 1 is a sectional view of a print head, showing the capacitance sensor electrodes used by the invented controller.

FIG. 1 is a sectional view of a spring-charged print head for a dot impact printer in which the present invention may be employed. The print head has a plurality of dot wires 2 affixed to the ends of a like plurality of armatures 4, which are attached to a like plurality of plate springs 6. Normally the springs 6 are held in the flexed position shown in the drawing by a magnetic field generated by a permanent magnet 8. In this position the springs 6 are in contact with the cores 10 of a plurality of electromagnets 11. The coils 12 of these electromagnets 11 are coupled to a drive circuit card 14 through which they can be supplied with exciting current.

A sensor circuit card 16 has a plurality of capacitance sensor electrodes 18 disposed facing respective armatures 4. Each electrode 18 and its paired armature 4 form a capacitor 20, the capacitance of which varies in response to the distance between the electrode 18 and armature 4. The armatures 4 are grounded. The electrodes 18 are coupled via the sensor circuit card 16 to a sensor circuit, which will be shown in FIG. 3.

Figure 2:
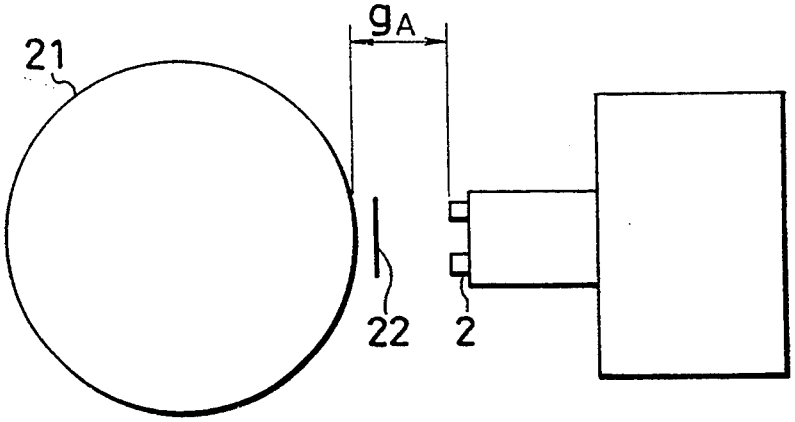
FIG. 2 is a sectional view of the print head and platen, illustrating the printing gap.

FIG. 2 is a sectional view showing the print head in relation to the platen 21 of the printer. In their retracted position (the position shown in FIG. 1), the dot wires 2 are separated from the platen 21 by a print gap $g_A$. An ink ribbon 22 is disposed in this gap.

Figure 3:
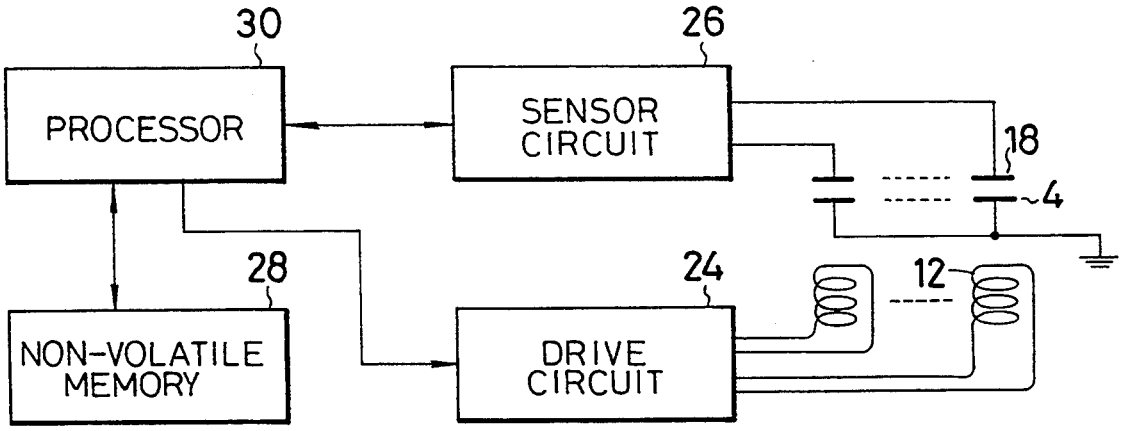
FIG. 3 is a block diagram of the invented controller.

FIG. 3 is a block diagram of the controller in accordance with the present invention, in which the capacitance sensor electrodes 18 and coils 12 are now depicted by standard electronic circuit symbols. The other elements of the controller are a drive circuit 24, a sensor circuit 26, a non-volatile memory 28, and a processor 30.

The drive circuit 24 feeds pulses of exciting current to the coils 12, to which it is coupled via the drive circuit card 14 in FIG. 1. A detailed description of the internal structure of the drive circuit 24 will be omitted, because similar circuits are employed in the prior art.

The sensor circuit 26 is switchably coupled to the sensor electrodes 18 via the sensor circuit card 16 in FIG. 1. When coupled to a particular sensor electrode 18, the sensor circuit 26 senses the capacitance of that electrode 18 and the corresponding armature 4, and produces a waveform representing the motion of the armature 4, hence the motion of the attached dot wire 2. The waveform may represent, for example, the displacement or velocity of the armature 4. Circuits capable of generating such waveforms are well known, so a detailed description of the internal structure of the sensor circuit 26 has been omitted.

The non-volatile memory 28 is a data-storage device having the following properties: the stored data are retained when the printer's power is turned off; and the data can be modified by writing new data electrically. The term "non-volatile memory" will be used herein to mean any memory device with these two properties. Specific examples include battery-backed-up random-access memory, electrically erasable and programmable read-only memory (EEPROM), and the so-called flash memory. The self-adjustment data stored in the non-volatile memory 28 will be described later.

The processor 30 is, for example, a microprocessor or microcontroller that has been programmed to read self-adjustment data from the non-volatile memory 28 and control the drive circuit 24 accordingly. The processor 30 is also programmed to execute a test sequence in which it receives waveform data from the sensor circuit 26 and writes new self-adjustment data in the non-volatile memory 28, thereby updating the self-adjustment data. Microprocessors, microcontrollers, and methods of programming them are well known, and accordingly, a detailed description of the structure of the processor 30 has been omitted.

Since the waveforms generated by the sensor electrodes 18 are analog in nature and the self-adjustment data stored in the non-volatile memory 28 are digital, at some point an analog-to-digital conversion process is necessary. This conversion process can be performed by a dedicated analog-to-digital converter, by voltage comparators and timers, or by other well-known devices. These devices may be disposed in the sensor circuit 26, in the processor 30, or in both the sensor circuit 26 and the processor 30.

Next the operation of the invented controller during normal printing and during a test sequence will be described with reference to FIGS. 1 to 3.

During normal printing, the processor 30 receives print data from a host device such as a personal computer (not shown in the drawings) to which the printer is connected. In response to these print data, the processor 30 causes the drive circuit 24 to feed pulses of exciting current to the coils 12 of the electromagnets 11 in FIG. 1. When excited by a current pulse, an electromagnet 11 generates a magnetic field that cancels the magnetic field of the permanent magnet 8, allowing the spring 6 to drive the armature 4 and dot wire 2 forward to print a dot. At the end of the current pulse, the magnetic field of the permanent magnet 8 retracts the spring 6, armature 4, and dot wire 2 to their original position.

The rate of the pulses, the duration of the pulses, or both the rate and duration of the pulses are controlled responsive to the self-adjustment data stored in the non-volatile memory 28. The rate of the pulses is proportional to the printing speed as measured, for example, in dots per second. The duration affects the darkness (density) of the printed dots, longer durations giving darker dots. Details of several schemes for controlling pulse rate and duration will be given later.

In a test sequence, the processor 30 controls the drive circuit 24 so that each dot wire 2 is actuated in turn, and controls the sensor circuit 26 so that when a certain dot wire 2 is actuated, the sensor circuit 26 is coupled to the corresponding sensor electrode 18. The processor 30 thus obtains waveform data representing the motion of the actuated dot wire. On the basis of these waveform data, the processor 30 updates the self-adjustment data stored in the non-volatile memory 28. Examples of specific waveform data will be shown later.

The processor 30 is preferably programmed to execute the test sequence and update the non-volatile memory 28 on its own initiative under certain conditions. For example, the processor 30 may be programmed to execute the test sequence if the printer is not supplied with paper when its power is switched on. Referring to FIG. 2, this enables the dot wires 2 to be driven against the platen 21 under known conditions, the printing gap not being altered by the presence of paper of uncertain thickness. It also avoids spoiling clean sheets of paper. In normal use a printer will occasionally be switched on without paper, so the self-adjustment data in the non-volatile memory 28 will be kept up to date without the user's having to take any special action.

The processor 30 can also be programmed to execute the test sequence and update the non-volatile memory 28 in response to a command entered from the printer's control panel, enabling the user to have the self-adjustment data updated whenever print quality deteriorates noticeably.

An advantage of the controller of the present invention, which tests the dot wires one by one, is that only a single sensor circuit 24 is required for all the dot wires. Controllers that operate on sensor data obtained in real time, during normal printing, require a separate sensor circuit 24 for each dot wire. They also place a heavier computational load on the processor 30.

Next, one purpose of updating the self-adjustment data will be described with reference to FIGS. 4 and 5.

Figure 4:
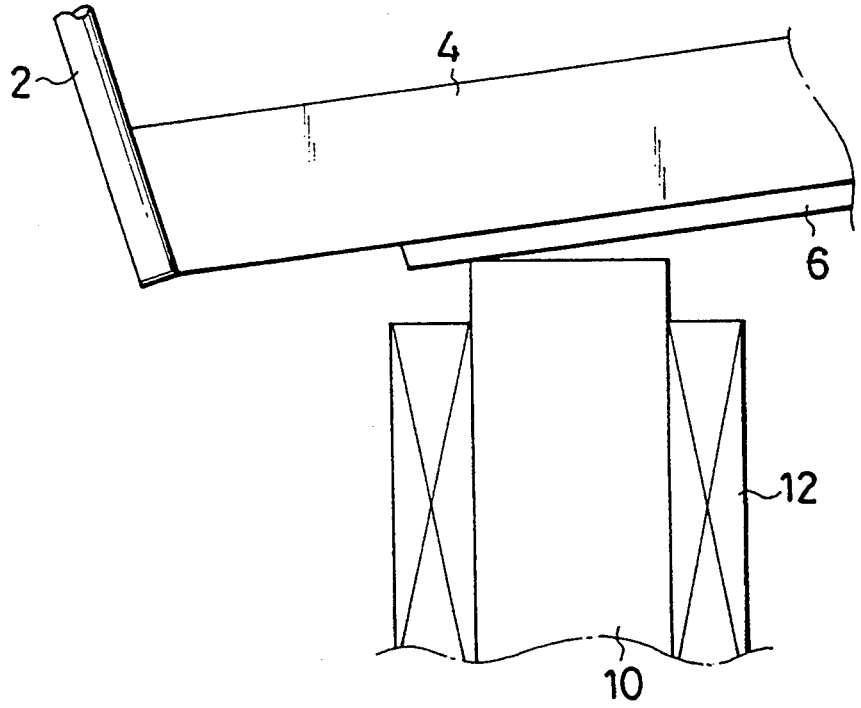
FIG. 4 illustrates the retracted position of an armature in a new print head.

FIG. 4 shows a new print head in which a dot wire 2, armature 4, and spring 6 are in their retracted position, the spring 6 resting against the core 10 of an electromagnet, the coil 12 not being energized. FIG. 5 shows the same state at a later point in the life of the print head, when the core 10 has been somewhat worn down through repeated impact by the spring 6 and armature 4. Because of this wear, the dot wire 2 is retracted farther than in the new state (indicated by dot-dash lines), the difference being a distance K. The dot wire 2 must now travel a distance $g_B = g_A + K$ to reach the platen, instead of the distance $g_A$ shown in FIG. 2.

Wear to the cores 10 of the electromagnets 11 is not the only reason for updating the self-adjustment data. Similar widening of the printing gap may be caused by wear to the tips of the dot wires 2, wear on the carriage mechanism (not illustrated in the drawings) that supports the platen, and other general wear and tear experienced by the printer during its service life.

Figure 5:
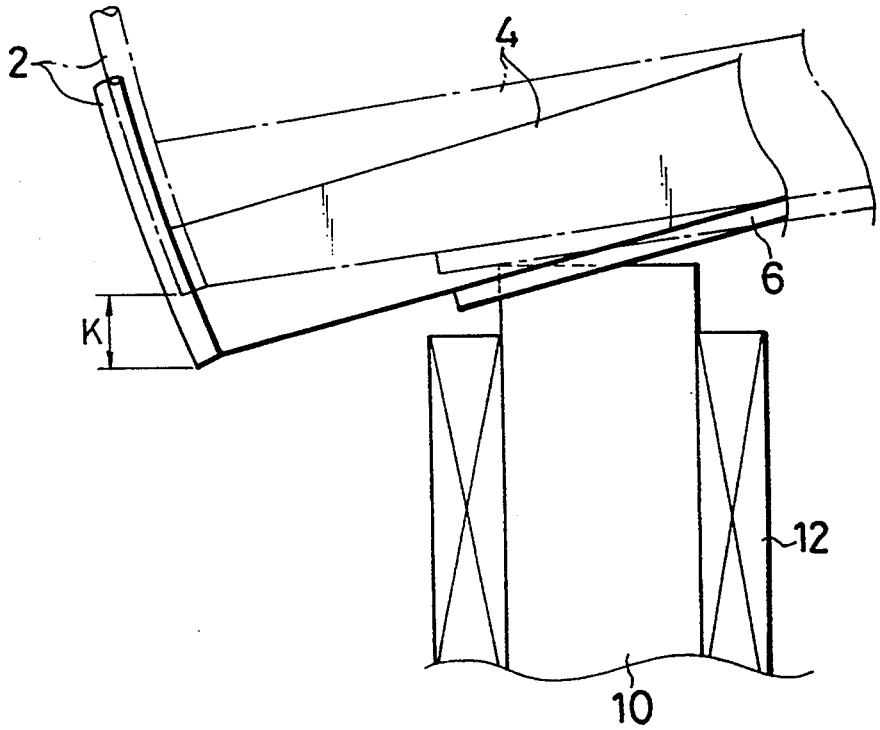
FIG. 5 illustrates the retracted position of an armature in an old print head.
Figure 6:
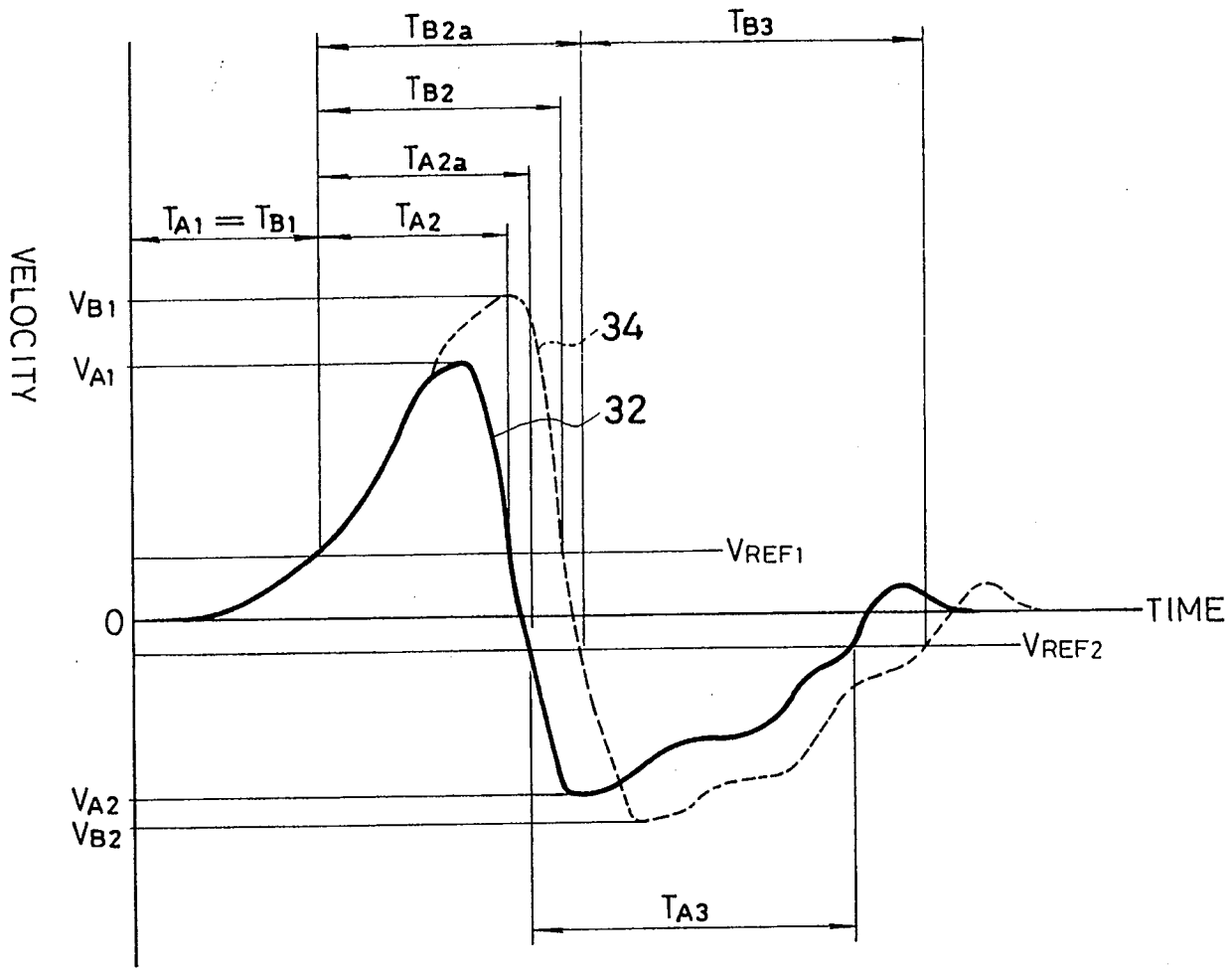
FIG. 6 illustrates velocity waveforms for the conditions shown in FIGS. 4 and 5.

FIG. 6 shows waveforms for the states illustrated in FIGS. 4 and 5, as obtained by the sensor circuit 26 during a test sequence. Time is shown on the horizontal axis and velocity on the vertical axis. Waveform 32 is for the new print head shown in FIG. 4. Waveform 34 is for the older print head shown in FIG. 5.

$V_{REF1}$ and $V_{REF2}$ are slice levels. When the processor 30 receives the waveform 32 or 34 from the sensor circuit 26, it determines the times at which the waveform intersects these slice levels. Specifically, it measures the time intervals $T_{A1}$, $T_{A2}$, $T_{A2a}$, and $T_{A3}$ for waveform 32, and $T_{B1}$, $T_{B2}$, $T_{B2a}$, and $T_{B3}$ for waveform 34. The intersections of the waveforms with slice level $V_{REF1}$ are considered to represent the starting and stopping times of forward motion of the dot wire 2. The intersections of the waveforms with slice level $V_{REF2}$ are considered to represent the starting and stopping times of backward motion of the dot wire 2. The sum of intervals $T_{A1}+T_{A2}$, or of intervals $T_{B1}+T_{B2}$, represents the time from the beginning of feeding of exciting current until forward motion is substantially stopped.

$V_{A1}$ and $V_{A2}$ are the maximum and minimum velocities, respectively, indicated by waveform 32. $V_{B1}$ and $V_{B2}$ are the maximum and minimum velocities indicated by waveform 34. The following relationships will generally hold between the timing and velocity data (subscript A) obtained when a print head is new and data (subscript B) obtained at a later time:

$T_{A1}=T_{B1}$
$T_{A2}\leqq T_{B2}$
$T_{A2a}\leqq T_{B2a}$
$T_{A3}\leqq T_{B3}$
$V_{A1}\leqq V_{B1}$
$V_{A2}\leqq V_{B2}$ The values of $T_{A1}$, $T_{A2}$, $T_{A2a}$, $T_{A3}$, $V_{A1}$, and $V_{A2}$ are stored as self-adjustment data in the non-volatile memory 28 at the factory, when the printer is manufactured. Later, when a test sequence produces waveform 34, the values will be updated to $T_{B1}$, $T_{B2}$, $T_{B2a}$, $T_{B3}$, $V_{B1}$, and $V_{B2}$.

Figure 7:
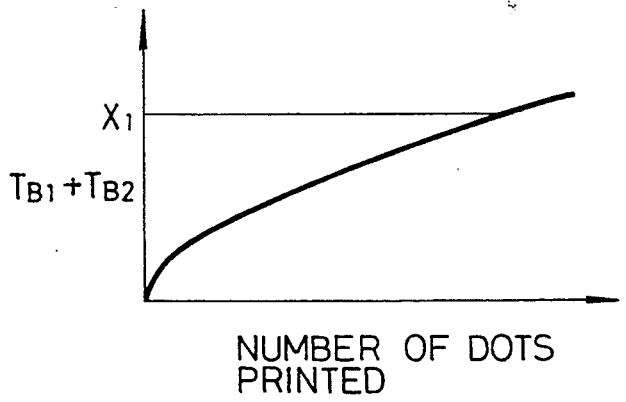
FIG. 7 is a graph illustrating the forward motion stopping time of a dot wire over the life of the print head.

FIG. 7 shows how the stopping time of forward motion, as represented by $T_{B1}+T_{B2}$, can be expected to vary during the life of a print head. The number of dots printed by a particular dot wire 2 is indicated on the horizontal axis, and the corresponding value of $T_{B1}+T_{B2}$ on the vertical axis. As the number of dots printed increases, it takes longer for the dot wire to reach the platen, as indicated by the rising value of $T_{B1}+T_{B2}$. When $T_{B1}+T_{B2}$ reaches a certain value $X_1$, there starts to be some danger that the dot wire will not reach the platen at all, resulting in faint or missing dots during normal printing.

Figure 8:
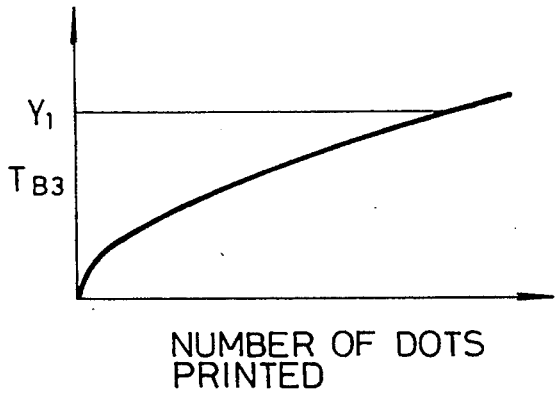
FIG. 8 is a graph illustrating the backward motion duration of a dot wire over the life of the print head.

FIG. 8 shows how backward motion time, as represented by $T_{B3}$, can be expected to vary during the life of the print head. The number of dots printed is again indicated on the horizontal axis, and $T_{B3}$ on the vertical axis. When $T_{B3}$ reaches a certain value $Y_1$, there begins to be some danger that the dot wire 2 will not return in time to be ready to print the next dot.

The processor 30 can be programmed to avoid these dangers in various ways. One particularly simple scheme is to have the processor 30 calculate the average values of $T_{B1}+T_{B2}$ and $T_{B3}$ for all the dot wires, and increase the pulse duration of exciting current for all dot wires when either of these average values exceeds the corresponding danger threshold $X_1$ or $Y_1$, Another possible scheme is to increase the duration of exciting pulses for all dot wires when the $T_{B1}+T_{B2}$ value of any individual dot wire exceeds $X_1$, or the $T_{B3}$ value of any individual dot wire exceeds $Y_1$. Yet another possible scheme is to increase the duration of exciting pulses for a particular dot wire when its $T_{B1}+T_{B2}$ value exceeds $X_1$, or its $T_{B3}$ value exceeds $Y_1$, The pulse duration can also be increased in a linear or stepwise manner responsive to $T_{B1}+T_{B2}$ or $T_{B3}$, instead of at a single threshold value.

Still another possible control scheme increases the pulse duration only when both of the following conditions are satisfied:

$$T_{B1} + T_{B2} \geqq X_1$$
$$T_{B3} \geqq Y_1$$

Figure 9:
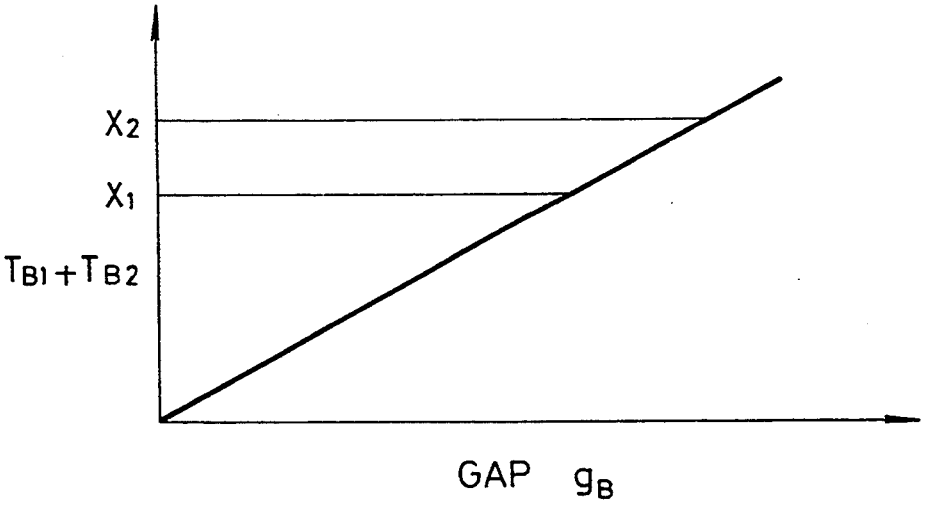
FIG. 9 is a graph illustrating the forward motion stopping time of a dot wire as a function of the printing gap.

FIG. 9 shows how the quantity $T_{B1}+T_{B2}$ depends on the printing gap $G_B$. The relationship is generally linear. As the printing gap increases due to increasing wear, there comes a point at which satisfactory printing quality can no longer be maintained just by increasing the duration of the exciting current pulses; it is also necessary to reduce the pulse rate, i.e. the printing speed. Accordingly, a second threshold $X_2$, higher than $X_1$, can be set, and the pulse rate can be reduced when the average value of $T_{B1}+T_{B2}$ for all dot wires exceeds $X_2$, or when the value of $T_{B1}+T_{B2}$ for any dot wire exceeds $X_2$.

If the self-adjustment data are used as explained above to compensate for wear on the print head and other parts of the printer, the printer can maintain good printing quality for the entire guaranteed life of its print head without having to overdrive the dot wires initially, and without requiring readjustment at the factory. In addition, the self-adjustment data can be used to compensate for differences between individual dot wires, as explained next.

Figure 10:
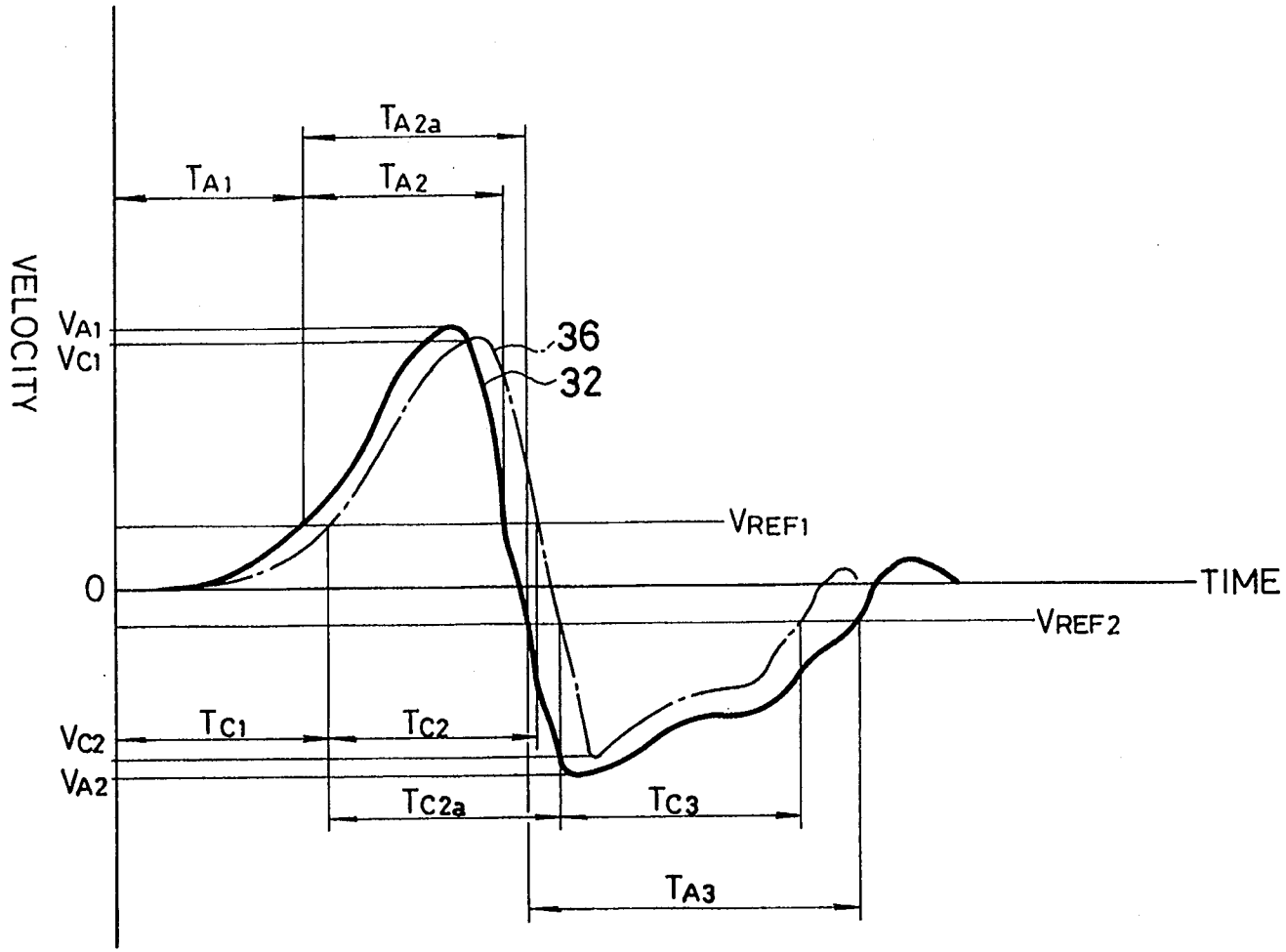
FIG. 10 illustrates waveforms for two different dot wires.

FIG. 10 shows waveforms for two different dot wires in a new print head. Waveform 32 and the time and velocity data with subscript A are the same as in FIG. 6, pertaining to a first dot wire. Waveform 36 and the time and velocity data with subscript C pertain to a second dot wire. Variations in the permanent magnetic field cause this second dot wire to release later and return faster than the first dot wire ($T_{A1}+T_{A2}<T_{C1}+T_{C2}$ and $T_{C3}<T_{A3}$). The processor 30 can be programmed to provide different exciting pulse durations for these two dot wires on the basis of self-adjustment data obtained from these waveforms, thereby assuring uniform printing quality despite the different characteristics of the dot wires.

The invention is not restricted to the control schemes outlined above. For example, pulse rate or duration can be controlled according to the sum of $T_{B1}+T_{B2}+T_{B3}$ in FIG. 6, or according to the maximum velocity $V_{B1}$, or according to some other parameter or combination of parameters. The self-adjustment data are not restricted to the six parameters indicated in FIGS. 6 and 10. Additional slice levels may be provided to obtain more detailed information about the waveforms. Also, instead of velocity waveforms, displacement waveforms, acceleration waveforms or other waveforms may be used.

When the processor 30 executes a test sequence, it can command the drive circuit 24 to drive the dot wires under the same pulse rate and pulse duration conditions as in normal printing, these being derived from the current self-adjustment data. However, a variety of other conditions may be employed instead. For example, the test sequence can always be executed under identical conditions, regardless of the self-adjustment data. Alternatively, when the processor 30 updates the non-volatile memory 28, it may store a new set of conditions for use in the next test sequence. The test sequence may also be executed several times consecutively under different conditions, to obtain more reliable self-adjustment data.

The drawings have shown a spring-charged print head, but the invention can also be applied to printers with clapper-type print heads.

Those skilled in the art will recognize that further modifications may be made without departing from the scope of the invention as claimed below.

What is claimed is:

1. A controller for controlling electromagnets that actuate dot wires in a dot impact printer, comprising:

a drive circuit for feeding pulses of exciting current to said electromagnets, thereby actuating said dot wires;

a plurality of capacitance sensor electrodes for sensing motion of respective dot wires;

a sensor circuit coupled to convert outputs from said capacitance sensor electrodes to waveform data;

a non-volatile memory for storing self-adjustment data; and a processor coupled to control said drive circuit responsive to said self-adjustment data during normal printing, to execute, at certain times, a test sequence in which each dot wire is actuated in turn, and to update said self-adjustment data according to said waveform data resulting from said test sequence;

wherein said processor increases durations of said pulses of exciting current when a predetermined characteristic of said waveform data exceeds a first threshold value;

wherein said processor also controls rates of said pulses of exciting current, thereby controlling printing speed, responsive to said self-adjustment data;

and wherein said processor reduces said rates of said pulses, thereby reducing said printing speed, if said predetermined characteristic of said waveform data exceeds a second threshold value, which is higher than said first threshold value.

2. The controller of claim 1, wherein said processor executes said test sequence if said printer is not supplied with paper when said printer's power is turned on.

3. The controller of claim 1, wherein said waveform data are velocity waveform data.

4. The controller of claim 1, wherein said waveform data are obtained by comparison of a waveform with a plurality of slice levels.

5. The controller of claim 1, wherein said predetermined characteristic of said waveform data is one of an amount of time needed for motion of one of the dot wires to be substantially completed, a maximum velocity of one of the dot wires, a maximum displacement or a maximum acceleration of one of the dot wires.

6. The controller of claim 1, wherein said waveform data is a maximum one of values of said predetermined characteristic for all of said dot wires, and said processor calculates, from said waveform data of all of said dot wires, said maximum one of said values, and controls the duration of said pulses for all of said dot wires, responsive to said maximum one of said values.

7. The controller of claim 1, wherein said waveform data is a value of said predetermined characteristic for each of said dot wires, and said processor controls the duration of said pulses for each of said dot wires, responsive to the waveform data for each of said dot wires.

8. A controller for controlling electromagnets that actuate dot wires in a dot impact printer, comprising:

a drive circuit for feeding pulses of exciting current to said electromagnets, thereby actuating said dot wires;

a plurality of capacitance sensor electrodes for sensing motion of respective dot wires;

a sensor circuit coupled to convert outputs from said capacitance sensor electrodes to waveform data;

a non-volatile memory for storing self-adjustment data; and a processor coupled to control said drive circuit responsive to said self-adjustment data during normal printing, to execute, at certain times, a test sequence in which each dot wire is actuated in turn, and to update said self-adjustment data according to said waveform data resulting from said test sequence;

wherein said processor increases durations of said pulses of exciting current when a predetermined characteristic of said waveform data exceeds a first threshold value;

wherein said waveform data is an average value for all of said dot wires, and said processor calculates said average value from said waveform data;

and wherein said processor also controls rates of said pulses of exciting current responsive to said average value, thereby controlling printing speed;

and wherein said processor reduces said rates of said pulses, thereby reducing said printing speed, if said average value exceeds a second threshold value, which is higher than said first threshold value.

9. The controller of claim 8, wherein said processor causes said drive circuit to increase said durations if said average value exceeds said first threshold value.

10. The controller of claim 8, wherein said average value is an average backward motion time of all of said dot wires.

11. The controller of claim 8, wherein said processor executes said test sequence if said printer is not supplied with paper when said printer's power is turned on.

12. The controller of claim 8, wherein said waveform data are velocity waveform data.

13. The controller of claim 8, wherein said waveform data are obtained by comparison of a waveform with a plurality of slice levels.

* * * * *